United States Patent [19]

Voswinckel

[11] Patent Number: 4,762,727

[45] Date of Patent: Aug. 9, 1988

[54] METHOD FOR APPLYING A LIQUEFIABLE MATERIAL ONTO A SUBSTRATE CONVEYED IN FORM OF A WEB

[75] Inventor: Gerhard Voswinckel, Aachen, Fed. Rep. of Germany

[73] Assignee: Gebrüder Sucker & Franz Müller GmbH & Co., MönchenGladbach, Fed. Rep. of Germany

[21] Appl. No.: 910,248

[22] Filed: Sep. 18, 1986

Related U.S. Application Data

[63] Continuation of Ser. No. 722,296, Apr. 11, 1985, abandoned.

[30] Foreign Application Priority Data

Apr. 12, 1984 [DE] Fed. Rep. of Germany ..... 3413807

[51] Int. Cl.[4] ..... B05D 1/26

[52] U.S. Cl. ..... 427/8; 427/209; 427/244

[58] Field of Search ..... 118/688, 692, 713, 410; 427/8–10, 209, 244

[56] References Cited

U.S. PATENT DOCUMENTS 4,237,818 12/1980 Clifford et al. ..... 118/410

4,381,730 5/1983 Arthur ..... 118/692 X

*Primary Examiner*—Evan K. Lawrence

*Attorney, Agent, or Firm*—Herbert L. Lerner; Laurence A. Greenberg

[57] ABSTRACT

Method for applying a liquefiable material in form of a foam or a high-viscosity solution from a storage container onto a substrate which is conveyed in form of a web, with the aid of an application device which is provided with at least one discharge opening which is oriented in a line transversely to the direction the web is moving. A stream of the liquefiable material is introduced at one end of the application device. This stream is metered and the quantity passing through per time unit is measured. Part of the stream of liquefiable material is discharged at the other end of the application device and conducted back to the storage container, and also the flow-through quantity per time unit is measured. The difference of the measured quantities passed through per time unit is compared to a nominal value. The parts of the stream are dosed such that the difference of the measured quantities passing through per time unit approaches the nominal value.

4 Claims, 1 Drawing Sheet

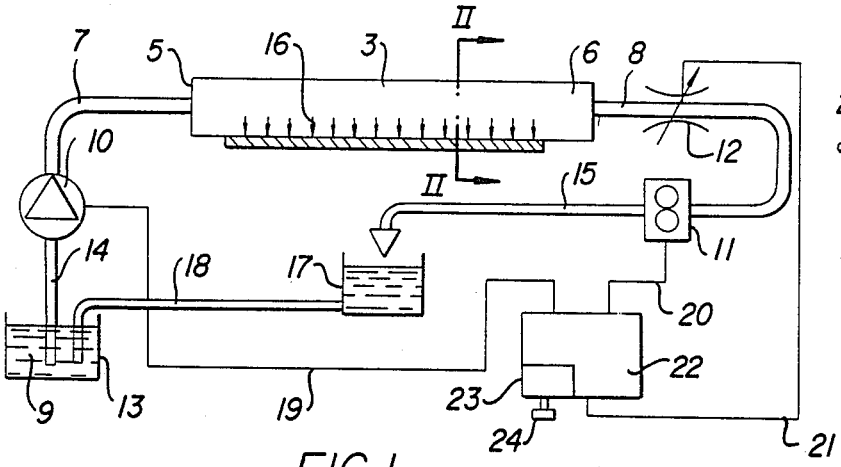
FIG. 1
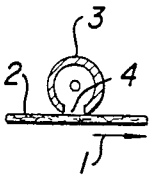
FIG. 2
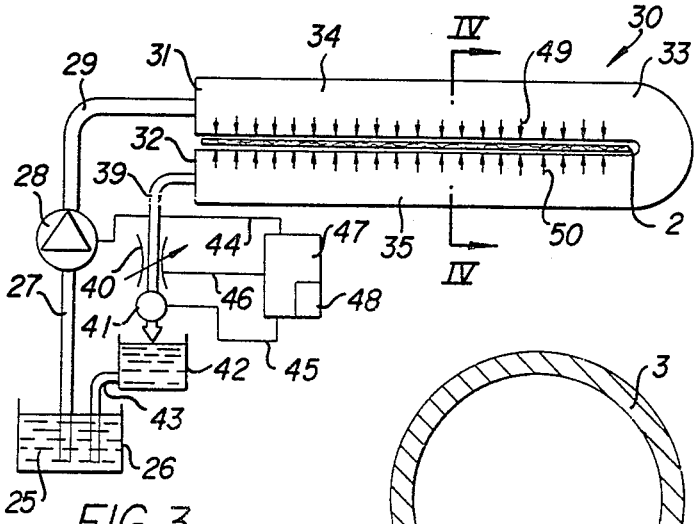
FIG. 3
FIG. 4
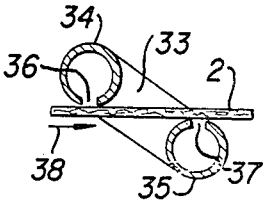
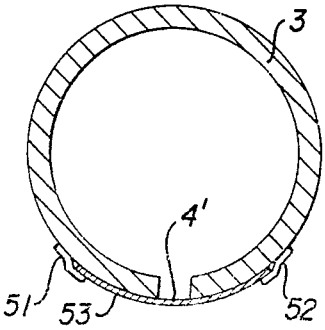
FIG. 5
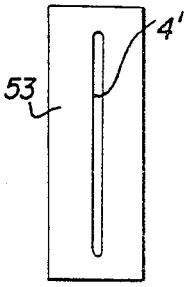
FIG. 6

METHOD FOR APPLYING A LIQUEFIABLE MATERIAL ONTO A SUBSTRATE CONVEYED IN FORM OF A WEB

This application is a continuation, of application Ser. No. 722,296, filed Apr. 11, 1985 now abandoned.

BACKGROUND OF THE INVENTION

1. Field of the Invention

The invention relates to a method for applying a liquefiable material in form of a foam, or a high viscosity solution from a storage container onto a substrate which is conveyed in form of a web, with the aid of an application device which is provided with at least one discharge opening which is oriented in a line transversely to the direction the web is moving.

When textiles, for example, are used as substrate, the liquefiable material applied are finishing agents, color-solutions, sizes, high viscosity solutions, dispersions, or foams.

It is known to coat or impregnate a substrate by bringing the substrate in contact with the liquefiable material over a certain contact distance. By allowing a certain reaction time, the penetration of the liquefiable material into the substrate is effected. Thereafter, the amount of liquefiable material per length unit of substrate is determined by squeezing rollers. It is also known to adjust hereby the quantity of the liquefiable material per length unit of the substrate by an exact dosing of the viscosity, without the use of squeezing rollers. It was also proposed in the past to introduce the liquefiable material immediately before, or directly into the gap between a pair of pressure rollers, and to dose it in this manner.

However, with the known methods and devices it is not possible to achieve a sufficiently controlled and adjustable coating or impregnation of the substrate.

SUMMARY OF THE INVENTION

A basic objective of the invention is to obtain a more uniform and defined application of a liquefiable material in the form of a foam, or high viscosity solution onto a substrate which is conveyed in form of a web.

With the foregoing and other objects in view, there is provided in accordance with the invention a method for applying a liquefiable material in form of a foam or a high-viscosity solution from a storage container onto a substrate which is conveyed in form of a web, with the aid of an application device which is provided with at least one discharge opening which is oriented in a line transversely to the direction the web is moving, which comprises introducing a stream of the liquefiable material at one end of the application device, metering this stream and measuring the quantity passing through per time unit, discharging part of said stream of liquefiable material at the other end of the application device, and conducting said discharged part of the stream back to the storage container, measuring the flow-through quantity per time unit of said discharged part of the stream, comparing the difference of the measured quantities passed through per time unit to a nominal value, and regulating the flow of the stream by dosing such that the difference of the measured quantities of liquefiable material entering and passing through per time unit approaches the nominal value.

For performing the method of the invention, there is provided an application apparatus for applying a liquefiable material in form of a foam, or a high viscosity solution from a storage container onto a substrate which is conveyed in form of a web with the aid of an application device which is provided with at least one discharge opening which is oriented in a line transversely to the direction the web is moving, the combination therewith of a feedline for introducing liquefiable material at one end of the application device and a return line at its other end for the discharge of liquefiable material, a first flow meter for measuring the quantity of liquid flowing into the application device is arranged upstream from the application device, a second flow meter is downstream from the application device and additionally a controllable metering device, and work connections are provided from the flow measuring devices to the controllable metering device.

Other features which are considered as characteristic for the invention are set forth in the appended claims.

Although the invention is illustrated and described herein as embodied in a method for applying a liquefiable material onto a substrate conveyed in form of a web, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which:

FIG. 1 shows a schematic representation of a first embodiment of the invention in which a stream of liquefiable material measured in a first flow meter is introduced at one end of an application device wherein a portion of the liquefiable material discharges through a long discharge opening onto a substrate which may be a textile material. A part of the liquefiable material discharges from the other end of the application device and returns through a return line in which is interposed a controllable metering device and a second flow meter. The first flow meter, the second flow meter and the controllable metering device are connected to an application-quantity control device which has a comparator.

FIG. 2 shows a section along the dash-dot line II—II indicated in FIG. 1.

FIG. 3 shows a schematic representation of a second typical embodiment in which application of the liquefiable material may be simultaneously made to the upper and lower sides of the substrate, FIG. 4 shows a section along dash-dot line IV—IV indicated in FIG. 3.

FIG. 5 shows a cross section through an application device.

FIG. 6 shows an exchangeable orifice plate for the application device according to FIG. 5.

DESCRIPTION OF THE PREFERRED EMBODIMENTS

The flow through the application device is continuous and through its whole length. Concentration changes, "dead zones", changes in the composition of the solution, or changes in the size of foam bubbles cannot or are unlikely to develop under these conditions, thus resulting in a very uniform application over the whole application width. The dosing of the liquefiable material applied to the substrate can be readily adjusted. The difference of the flow rates of the liquefiable material entering and leaving the application device is continuously determined by measuring or metering the entering material and correspondingly the part of the flow of material which is returned is also metered or measured. The difference in flow of the liquefiable material entering and leaving the application device follows specified nominal values. At any point in time one can determine how much material is applied, so that by monitoring the process one can determine at what places the substrate did receive the application quantity corresponding to the nominal value, and where not.

According to a further development of the invention, it is provided that the stream which is introduced into the application device, and/or the part of the stream which is conducted out of the application device is so dosed that the difference of the measured flow-through quantities per time unit has a preset value, corresponding to the desired application.

Accordingly, the constant control of the applied quantity is regulated either by the dosing of the part of the stream which leaves the application device, or by simultaneous, or exclusively dosing of the inflowing stream which, for example, may be controlled dependent on its velocity. It may be more advantageous, instead of only metering the part stream (return stream), to also meter the main stream flowing into the application device especially if strong deviations from the nominal value over short time periods are to be expected.

An apparatus is provided for performing the method of the invention, wherein the application device has at one end a feedline and at its other end a return line for the liquefiable material. A first flow meter is arranged upstream from the application device and downstream from the application device a second flow meter is positioned for measuring the quantities of the liquid leaving the application device. Additionally, a controllable metering device is employed and work connections are provided from the flow measuring devices to the dosing device. Furthermore, a controllable dosing device may also be provided in the feedline.

The first flow-through measuring device can be constructed in the form of a metering pump. In this case flow meter and dosing device are combined in one unit. The dosing pump can be provided with control means and be used to regulate the quantity of material which is applied. For example, the first flow-through measuring device may also be constructed as a mixer and metering pump for foam. The same applies also for flow meters of this type.

The work connections are conducted to an application-quantity control device. For example, this application quantity control device comprises a comparator which compares the difference of the measured flow quantities per time unit with a desired nominal difference value which corresponds to the desired quantity to be applied. The comparator may be a computer or computer component, as is known.

According to one embodiment of the invention the dosing device is constructed in the form of a controllable flow control valve.

If one expects that application from only one side will not achieve the required uniform wetting or soaking of the substrate over its total cross section, according to a further development of the invention, the application device can be constructed in two parts, whereby one part is disposed above, and the other part below the substrate, which is conveyed in form of a web. Such an arrangement contributes to make the application of the material to the substrate even more uniform.

According to a further development of the invention, the application openings of the application device are made adjustable. For example, for this purpose exchangeable orifice plates may be provided. Thereby, the width of the orifice has a direct influence on the amount of liquefiable material which is applied, while the length of the orifice depends more particularly on the width of the substrate web.

It is not necessary to conduct the returning portion of the flow directly into the storage container. In some cases it may serve the purpose to provide an intermediate container, in which, for example, a foam is ventilated.

Specific embodiments of the invention which are used as examples are shown in the drawings. The invention will be further explained and described with the aid of these typical embodiments.

In the first typical embodiment according to FIGS. 1 and 2, a substrate 2 is conveyed in form of a web in the direction of arrow 1. A tubular application device 3 arranged above the substrate 2 has a long discharge opening 4 which is directed toward the substrate 2. The application device 3 is provided at one end 5 with a feed line 7 and at its other end 6 with a return line 8 for a liquefiable substance 9. Upstream from the application device 3 is a first flow meter 10 for measuring the quantity of liquid passed into application device 3. Downstream from the application device 3 a second flow meter 11 is positioned to measure the quantity of liquid leaving the application device 3. Additionally, a controllable metering device 12 is arranged in the return line 8.

The first flow meter 10 is constructed in the form of a metering pump, the second flow meter can be a bucket-wheel counter, for example. The metering (dosing) device 12 is constructed as a flow adjustment valve with control means.

The liquefiable medium 9 is moved from a storage container 13, through a line 14 to the metering pump 10, from there through a line 7 into the application device 3. Part of the flow of liquefiable substance in application device 3 discharges onto the substrate 2 in the direction of the arrows 16, and the other part of the liquefiable substance moves on through the return line 8, through the metering device 12 and through the second flow meter 11 into a line 15, from which it runs freely into an intermediate container 17 which is connected by a pipe connection 18 with the storage container 13.

A work connection 19, i.e. a line conductor for conducting an electric signal, from the first flow meter 10 and a work connection 20 from the second flow meter 11 are provided to an application-quantity control device 22. An additional work connection 21 from the output of the application-quantity control device 22 leads to the metering device 12. The application-quantity control device 22 comprises a comparator 23, which compares the difference of the quantity of the passed flow per time unit (flow rate) with a nominal difference value which corresponds to the desired quantity of application medium to be applied. The desired value can be set by a nominal value setting control 24.

The values of the flow rates are transmitted through work connections 19 and 20 to the application-quantity control device 22, in which their difference is formed and compared with the set nominal value. At the occurrence of deviations from the nominal value, the metering device 12 is adjusted by means of the work connection 21.

In the second embodiment used as an example, according to FIGS. 3 and 4, the liquefiable substance 25 moves from a storage container 26, through a pipe line 27, to a first flow meter 28, which in this case is constructed as a mixing and metering pump for foam. The foamed substance from flow meter 28 moves through a feed line 29 discharging into an application device 30 at its end 31.

The application device 30 is constructed in a special form. It is also tube-shaped, but has two tube legs 34 and 35, which are connected by an arc-shaped tube section 33. Tube legs 34 and 35 have respective elongated discharge orifices 36 and 37. As shown in FIG. 4, the discharge orifices are arranged in the tube legs and the substrate 2 is conveyed between the tube legs 34 and 35 in the direction of arrow 38 such that the discharge orifice 36 in tube leg 34 is above the substrate 2 and the discharge orifice 37 in tube leg 35 is below the substrate 2.

Part of the flow of the foamed substance from the other end 32 of the application device 30 discharges through a return line 39, and through a metering device 40 to a second flow meter 41, which measures the quantity of liquid passing through it and then the foamed substance flows freely into an intermediate container 42. The intermediate container 42 is connected with the storage container 26 by the connecting pipe 43.

A work connection 44 from the flow meter 28 and an additional work connection 45 from the second flow meter 41 lead to an application-quantity control device 47. The application-quantity control device 47 here is also provided with a comparator 48, which compares the difference of the quantities passed through with a desired nominal difference value which corresponds to the quantity one intends to apply. From the output of the application-quantity control device 47 an additional work connection 46 leads to the metering device 40, which also in this example is constructed as an adjustable flow control valve.

In contrast to the first embodiment which was used as an example, in this case the liquefiable substance is foamed. The greater part of the foamed material which reaches the application device 30 is applied to the substrate 2 from the top in the direction of arrow 49, and from the bottom in the direction of arrow 50. As in the first embodiment, the returning portion of the flow is dosed such that the substrate 2 receives the required quantity of application substance.

FIG. 5 shows that an application device, for example, the application device 3 of the first embodiment, may be provided with an adjustable discharge orifice 4'. Here the adjustment capability is achieved by the feature that a slideable orifice plate 53 can be inserted between orifice plate holders 51 and 52. FIG. 6 shows that the discharge orifice 4' in the slideable orifice plate 53 can be constructed in the form of an elongated slot. Instead of a slot, individual holes arranged in a straight line may be provided. If the length of the discharge opening is to be changed, a different orifice plate which has the discharge opening of desired length is inserted.

The invention should not be limited to the illustrated and described embodiments which were used as examples. For instance, the adjustment capability of the discharge opening could be effected by sliding parts by which the length and width of the discharge opening can be adjusted. More labor for changing of the discharge opening is required in this case, but one does not require an assortment of several plates with different discharge orifices.

There is claimed:

1. Method for applying a liquefiable material in the form of a foam or a high-viscosity solution from a storage container onto a substrate which is conveyed in form of a web, with the aid of a tubular application device which is provided with at least one discharge opening which is oriented in a line transversely to the direction the web is moving, which comprises introducing a stream of the liquefiable material at one end of the application device, metering said stream entering at one end and measuring the quantity of the liquefiable material introduced into the application device per time unit, applying a part of the liquefiable material in the application device through said at least one discharge opening therein onto the web disposed outside the application device, and discharging another part of said stream of liquefiable material at the other end of the application device, flowing liquefiable material continuously through the length of the tubular application device from the one end to the other end, and conducting said discharged part of the stream back to the storage container, passing said discharged part of the stream through a flow meter and measuring the flow-through quantity per time unit of said discharged part of the stream, comparing the difference of the measured quantities of liquefiable material entering the application device at the one end and liquefiable material discharging at the other end of the application device per time unit to a nominal value, and regulating the flow of the stream by dosing such that the difference of the measured quantities of liquefiable material entering at one end of the application device and discharging at the other end of the application device per time unit approaches the nominal value.

2. Method according to claim 1, wherein said dosing comprises regulating at least one of (a) the stream flow which is introduced at the one end into the application device, and (b) the part of the stream flow which is discharged from the application device at the other end so that the difference of the measured flow-through quantities per time unit has a pre-set value corresponding to a desired application.

3. Method according to claim 1, wherein the tubular application device is disposed substantially horizontally with a long discharge opening at its bottom and with the web disposed underneath the opening and wherein the liquefiable material flowing through the tubular application device in part discharges through the long discharge opening onto the substrate beneath it.

4. Method according to claim 1, wherein the application device is U-shaped with two tube legs connected by an arc-shaped tube, such application device being disposed substantially horizontally with one leg at an elevation above the other leg to permit the passage of the substrate between the legs and with an elongated discharge orifice at the bottom of the upper leg and a discharge orifice at the top of the lower leg, wherein liquefiable material continuously flowing through the tubular application device discharges in part through the orifices onto the top and the bottom sides of the substrate.

* * * * *